United States Patent [19]

Santasalo et al.

[11] Patent Number: 4,942,847

[45] Date of Patent: Jul. 24, 1990

[54] GENERATION AND ACCUMULATION OF STEAM

[75] Inventors: Lauri Santasalo, Helsinki; Esko Huhta-Koivisto, Espoo, both of Finland

[73] Assignee: Oy Santasalo-Sohlberg AB, Finland

[21] Appl. No.: 303,160

[22] Filed: Jan. 27, 1989

[30] Foreign Application Priority Data

Jan. 28, 1988 [FI] Finland ..... 880392

[51] Int. Cl.[5] ..... F22B 37/22

[52] U.S. Cl. ..... 122/35; 122/459

[58] Field of Search ..... 422/26, 295, 298; 122/40, 35, 459, 13 A; 60/659

[56] References Cited

U.S. PATENT DOCUMENTS

| | | | |
|---|---|---|---|
| 2,398,048 | 4/1946 | Schmidt | 122/459 X |
| 3,450,487 | 6/1969 | Wallden | 122/459 X |
| 3,481,692 | 12/1969 | Linder | 422/26 X |
| 4,342,730 | 8/1982 | Perrotta | 422/298 X |
| 4,556,018 | 12/1985 | Agata | 122/35 |
| 4,808,377 | 2/1989 | Childers et al. | 422/26 |

*Primary Examiner*—Edward G. Favors

*Attorney, Agent, or Firm*—Steinberg & Raskin

[57] ABSTRACT

A procedure and apparatus for generating steam for an autoclave or an equivalent device, so that the load of the autoclave or device can be equalized. Thermal energy is stored in water under pressure which is converted when needed into steam which, in turn, is accumulated and later purified. The present invention also concerns the use of the procedure and apparatus to equalize load in the autoclave or device.

16 Claims, 4 Drawing Sheets

GENERATION AND ACCUMULATION OF STEAM

BACKGROUND OF THE INVENTION

The present invention concerns procedure and means for generating and accumulating steam for an autoclave or equivalent device, with which the load of the autoclave or equivalent device can be equalized. The present invention is also directed to the use of such procedure and means for equalizing the load of the autoclave or equivalent steam-operated apparatus.

In hospitals and in the pharmaceutical industry, instruments are presently sterilized with steam in an autoclave, this steam being generated in boilers from ordinary, softened tap water. When a steam space of a steam generator is connected with the autoclave which is under vacuum, the pressure is equalized in a moment, and as the pressure quickly drops, the water in the steam generator boils with frothing. Such froth may then also contaminate the objects being sterilized which are lodged in the autoclave. The droplets in the froth contain salts, rust, dead bacteria and germs, in addition to pyrogenic substances, which are normally present in drinking water. The impure steam carries these above-noted substances onto the goods being sterilized, which may, e.g., cause fever or infection in patients being operated upon.

In order to achieve a sufficient pressure for sterilizing in a short period of time in the autoclave, a steam generator with a high maximum output is required.

In order to prevent some of the above-noted problems, a filter has been used in the prior art for purifying steam. However, the filter tends to become clogged and fails to eliminate the drawbacks which result from the periodic steam discharge.

SUMMARY OF THE INVENTION

Accordingly, it is an object of the present invention to purify steam to a sufficient degree of purity for meeting requirements of injection solutions, and to prevent access of impure steam to substances being sterilized or into an autoclave and other equipment related to drug preparation and to sterilization, such as distribution pipe systems and ventilation apparatus.

It is also an object of the present invention to regulate power consumption of an autoclave or equivalent device as uniformly as possible, so that the autoclave or device will not draw high peak loads from the mains.

Accordingly, these and other objects are attained by the present invention which is directed to a procedure for generating and accumulating steam for an autoclave or equivalent steam-operated device, which comprises the steps of storing thermal energy in water that is under pressure, turning at least part of the water stored under pressure into steam as required, and accumulating the steam for use in the autoclave or equivalent device as needed, so that load of the autoclave or device can be equalized by introducing the steam thereinto. Additionally, the accumulated steam may be passed through a purifyer to purify the same, prior to introduction into the autoclave or equivalent device.

The present invention is also directed to apparatus for generating and accumulating steam for equalizing load in an autoclave or equivalent steam-operated device, which comprises a boiler or tank for containing water under pressure, means for feeding the water into the boiler or tank, means for heating the water in the boiler or tank, and means for accumulating the steam generated from the water in the tank or boiler. Additionally, means for generating steam from the water inside the boiler or tank are provided. In particular, the feeding means comprise a pump and the heating means comprise a heating element, with a steam withdrawal outlet from the boiler or tank being provided, along with a purifier for purifying the steam generated in the boiler or tank and coupled to the steam withdrawal outlet.

For achieving the above-noted objects, the procedure of the present invention is principally characterized by heat energy being stored in water under pressure higher than atmospheric pressure and being turned into steam therefrom as required, such steam being accumulated and later purified with the aid of a purifyer.

Apparatus or means of the present invention is characterized by comprising a boiler in which the thermal energy is stored in water under pressure, a heating element for heating the water, a pump for supplying the water to the boiler, centrifugal purifier for purifying the generated steam, members for accumulating steam and a steam withdrawal outlet.

The present invention is also directed to a procedure for equalizing the load of an autoclave or equivalent steam-operated apparatus, which comprises the use of the above-noted procedure and/or the above-noted means/apparatus.

The steam generator and accumulator of the present invention comprises a sufficiently large tank and a small heating element. The tank capacity contains, e.g., about two thirds water, about one third being reserved for the steam. The pressure that is used has to be considerably greater than the sterilizing pressure, e.g. about 8 bar. The energy is latent in the water in the form of heat capacity, and when the pressure in the boiler falls or the connection to the vacuum in the autoclave is opened, the water is converted into steam. The steam thus-generated is stored in the apparatus and is purified in a manner known per se in the art, e.g. in centrifugal means or in a purifier of another type.

If, for example, a 130 $dm^3$ steam autoclave is used, it operates normally with 25 kW boiler power, while due to the present invention, only 5 kW are needed for the boiler. When this power input of the apparatus is maintained, its pressure will only fall to a critical level when the autoclave is used 8 to 10 hours per twenty four hours. The steam generator of the present invention may be used in two ways: either with overnight charging or periodically. For example, the load of the autoclave or equivalent steam-operated apparatus is equalized on a twenty-four hour basis.

If, for example, 6 kW power input is used, sterilization can be continued around the clock, the normal breaks associated with working stretches being taken into consideration. In this case, a uniform loading will be achieved which is about 4.5 kW per 100 liters of chamber volume. It is also feasible to construct large chambers designed for $\frac{1}{4}$ power and operated on a round-the-clock uniform basis.

BRIEF DESCRIPTION OF THE DRAWINGS

The present invention will be described in greater detail below, with the aid of the accompanying drawings, and to which, however, the present invention is not intended to be restricted. In the drawings.

DESCRIPTION OF THE PREFERRED EMBODIMENTS

Figure 1:
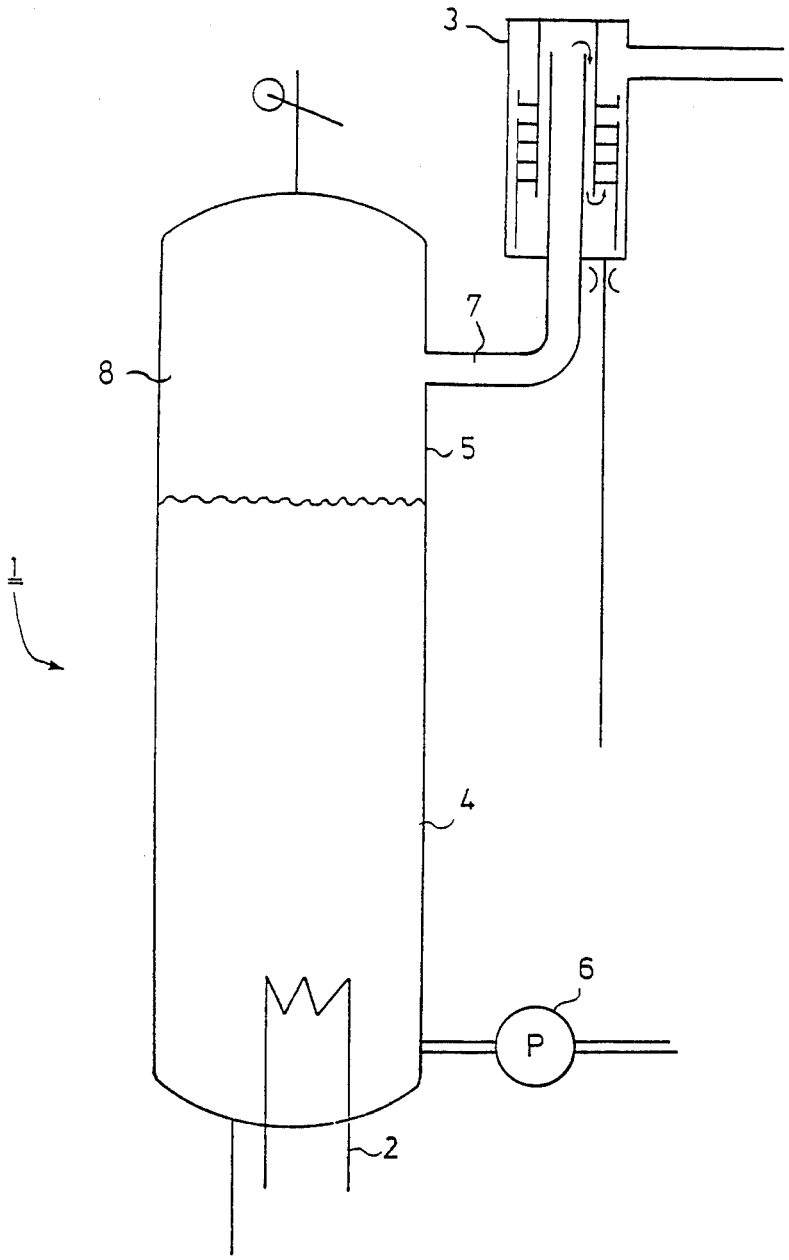
FIG. 1 is a schematic, cross-sectional view of an embodiments of the means or apparatus of the present invention, in which a heating element is connected inside a boiler and a centrifugal purifier is connected outside of the boiler.

In FIG. 1, the means or apparatus of the present invention is generally denoted by reference numeral 1, said means containing water 4 about ⅔ of the volume of a tank 5, while the remainder of the tank 5 is reserved as a steam space 8 as illustrated. This energy is in latent form in the water 4, constituting the heat capacity of the water. When the pressure drops, the energy is converted to free steam. The water does not boil violently in the procedure of the present invention, and therefore, the released steam does not contain water drops. The heating element, with which the water 4 is heated to the requisite temperature, and which, in the embodiment illustrated in FIG. 1 is connected inside the boiler 5, is denoted by reference numeral 2. Alternatively, the heating element 2 may be connected outside of the boiler 5.

The pump with which water 4 is fed into the tank or boiler 5, is denoted by reference numeral 6. The steam stored in the apparatus and taken from boiler 5 through an outlet 7, is purified with a centrifugal purifier denoted by reference numeral 3. When the steam exits from the centrifugal purifier 3, further along a pipe or outlet 7 as illustrated, the degree of purity meets the standard which is required of water intended for injection solutions. The purifier, advantageously a centrifugal purifier, is connected out-side of the boiler 5 as illustrated in FIG. 1. However, the purifier may alternatively be connected in conjunction with the boiler 5 itself, i.e. inside thereof.

Figure 2:
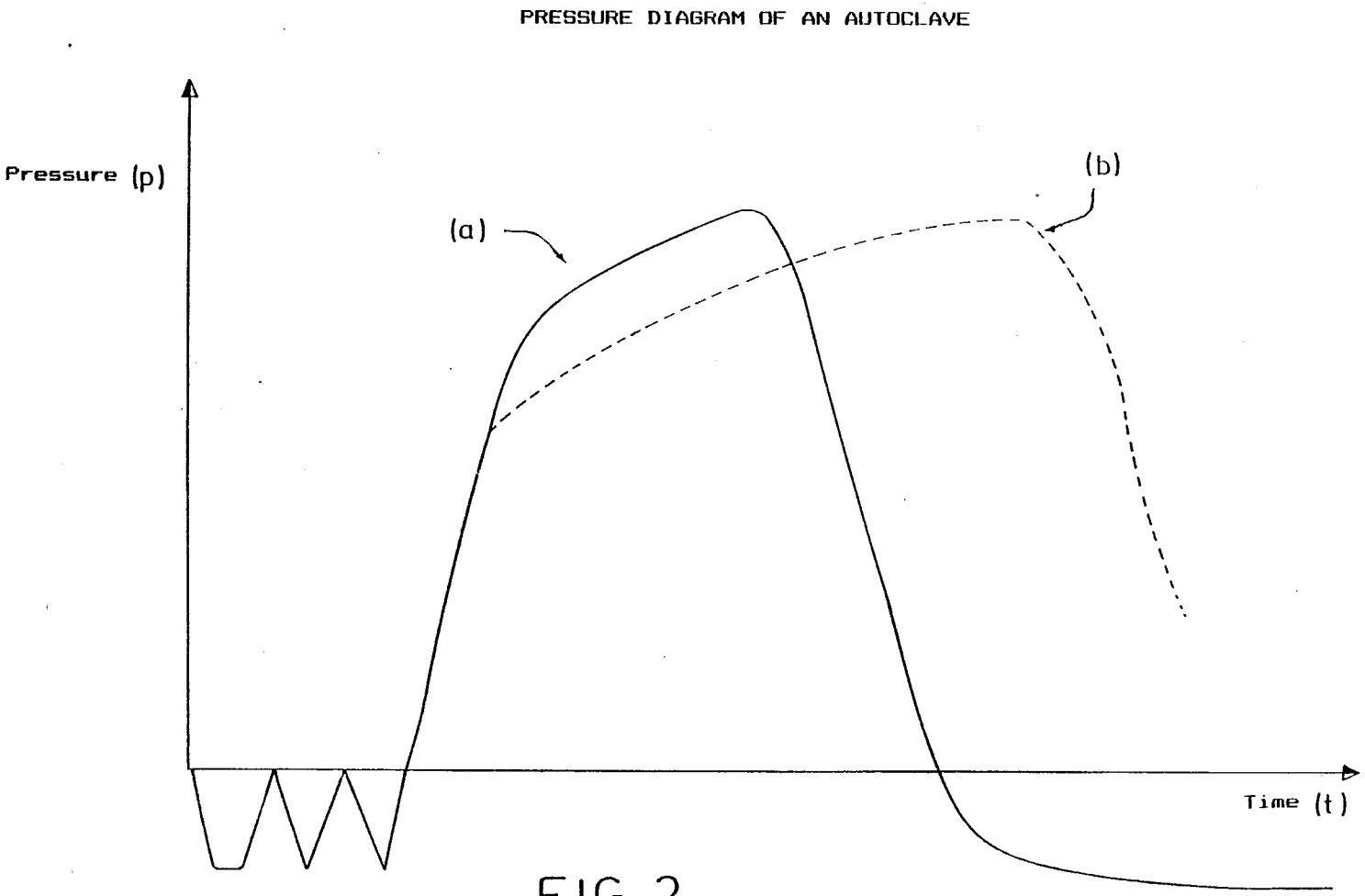
FIG. 2 illustrates a pressure graph of an autoclave chamber in accordance with the present invention.

FIG. 2 presents a pressure graph of the autoclave. As described above, the pressure can be made to conform without delay to this graph, with the aid of the steam accumulator 1 of the present invention. Without the steam accumulator 1, the steam from the boiler will not suffice to produce the rapid pressure elevation (graph a) and the sterilizing time will be prolonged if the temperature rises slower (graph b). Plot (b) is denoted as a dotted line in FIG. 2.

Figure 3:
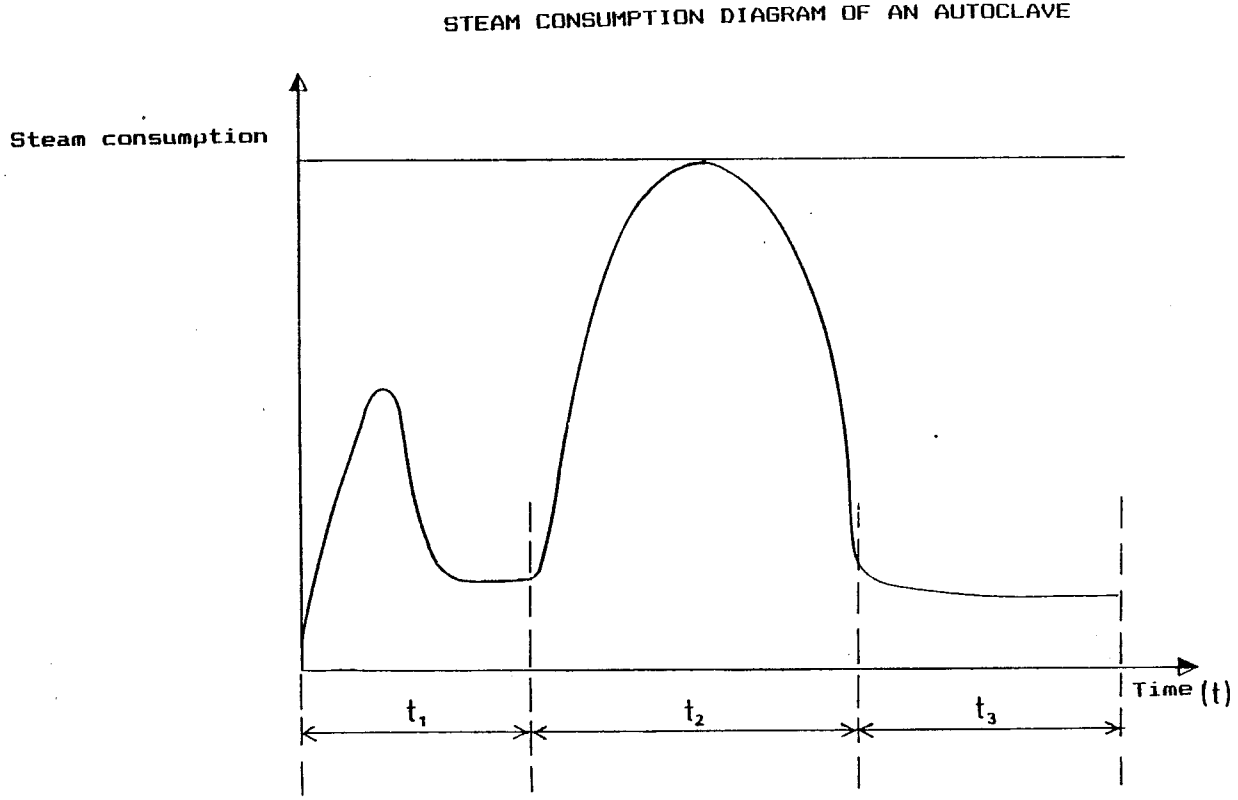
FIG. 3 illustrates a steam consumption graph of an autoclave used in conjunction with the means and procedure of the present invention.

FIG. 3 illustrates a steam consumption graph of an autoclave used in conjunction with the steam generator 1 of the present invention, plotted over time. Before sterilization, the apparatus is allowed to be preheated for a period of time indicated by $t_1$, at the beginning of which, when the autoclave is switch on, the steam consumption is greatest, and after which the steam consumption quickly decreases to a given, relatively low level as illustrated. The actual sterilizing time is denoted by $t_2$, in the course of which the steam consumption after first rising steeply, reaches its peak, after which the steam consumption again descends steeply, being at a given, relatively low level during the drying process which is denoted by $t_3$.

It is thus understood that the steam consumption of the autoclave has two peaks during the sterilizing process: the first and smaller peak occurring while the autoclave is being preheated ($t_1$) when the autoclave is started; and the second peak during the actual sterilization ($t_2$). With the aid of the steam accumulator 1 of the present invention, steam at sufficiently high pressure is available for the autoclave at all times, this being very important in view of speedy processing. In other words, only the peak loads of the autoclave or equivalent steam-operated apparatus need be equalized with the present invention herein.

Figure 4:
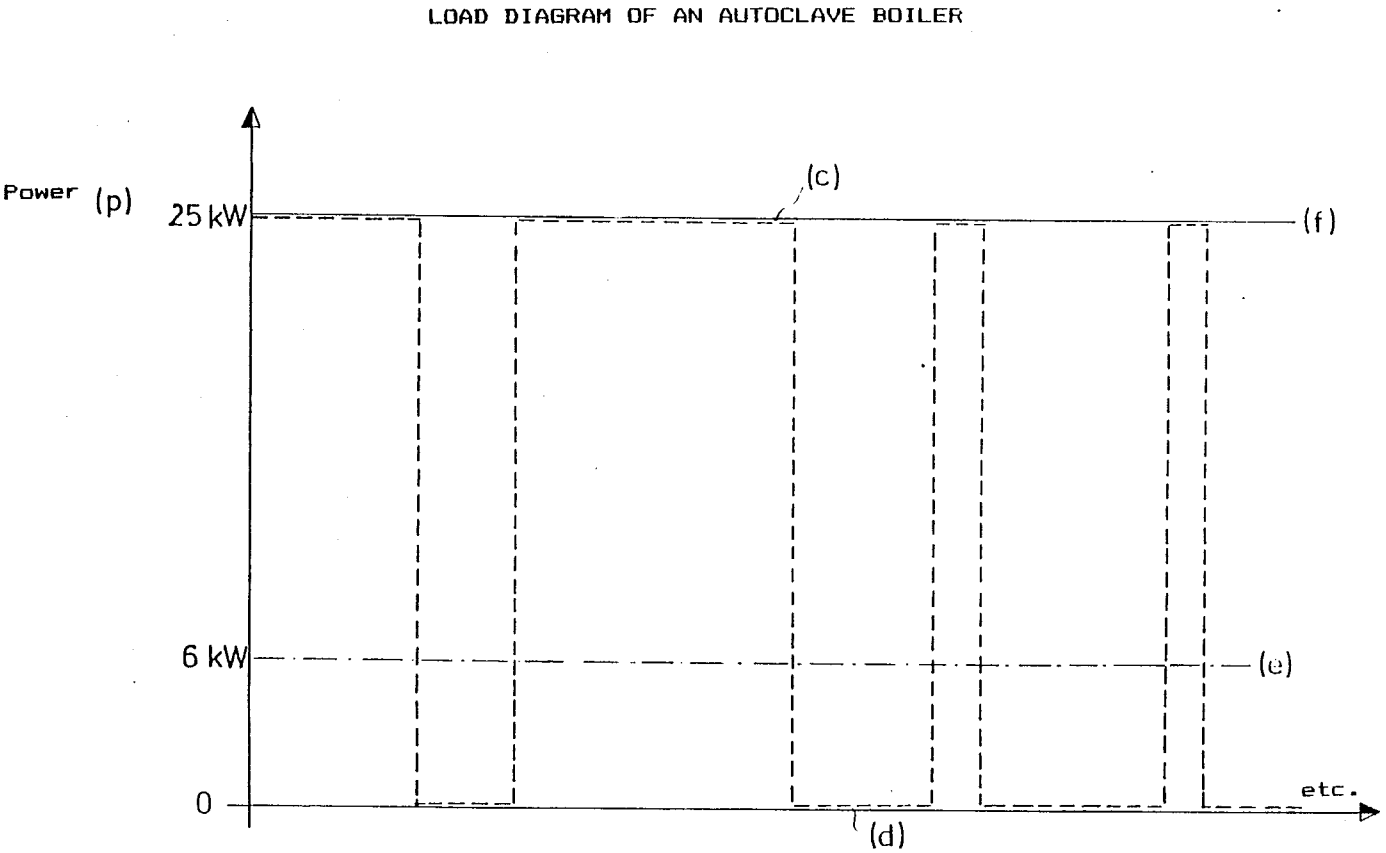
FIG. 4 is a graph illustrating coupling and loading of an autoclave boiler in accordance with the present invention.

FIG. 4 illustrates an example of the autoclave boiler load graph as plotted over time. The highest power demand of the steam autoclave (about 25 kW) is indicated by a solid line (f). A 25 kW boiler was previously needed (f) for the problem solution of the prior art. During pre-heating of the autoclave, the power uptake varies from zero to the highest value. During sterilization, the power is at its maximum, being variable again from zero to maximum during drying. The power uptake while the steam generator is on (c) and during the so-called off times (d) is illustrated in FIG. 4 with dotted lines for the exemplary case. This power demand can be levelled out with the steam generator 1 and the procedure of the present invention, at about 6 kW (e) in the present example, whereby only 6 kW continuous power consumption is required.

The apparatus and procedure described above may be used as a steam source for other purposes, such as heating, air or gas humidifying, etc., where sterile particle-free and pyrogen-free steam is needed.

A few examples in which the steam generator of the present invention is used in conjunction with a sterilizing autoclave, are presented below. The results are presented in Tables 1 and 2.

The preceding description of the present invention is merely exemplary, and is not intended to limit the scope thereof in any way.

TABLE 1

| | | Sterilization No. | | | | | | | |
|---|---|---|---|---|---|---|---|---|---|
| | | 1 | 2 | 3 | 4 | 5 | 6 | 7 | 8 |
| Steam Accumulator | Feed water quantity in column (l) | 200 | 188 | 182 | 178 | 173 | 169 | 164 | 156 |
| | Heating time (min) | 11 | | | | | | | |
| | Pressure before sterilizing (bar) | 6.2 | 5.0 | 4.5 | 4.0 | 3.6 | 3.3 | 3.0 | 3.8 |
| | Pressure after sterilizing (bar) | 5.0 | 4.5 | 4.0 | 3.6 | 3.3 | 3.0 | 2.5 | |
| | Condensate quantity (l) | 10 | 0.5 | 0.5 | 0.5 | 0.5 | 0.5 | 0.5 | |
| | Condensate temperature (°C.) | | | | | | | | |
| | Steam conductivity (μS/cm) | | | | | | | | |

TABLE 1-continued

| | | Sterilization No. | | | | | | | |
|---|---|---|---|---|---|---|---|---|---|
| | | 1 | 2 | 3 | 4 | 5 | 6 | 7 | 8 |
| | Remarks | During the preheating time the pressure fell 7.5 to 6.2 bar | | | | | | No more transition to sterilizing | Heating of steam generator, no steriliz. |
| | Sterilization starting time | 09.25 | 09.55 | 10.30 | 11.05 | 11.35 | 12.07 | 12.37 | 14.40 |
| Autoclave | Steam pressure (bar) | 2.4 | 2.4 | 2.4 | 2.4 | 2.4 | 2.4 | 2.4 | 2.4 |
| | Sterilizing time (min) | 12 | 12 | 12 | 12 | 12 | 12 | 12 | 12 |
| | Total time (min) | 30 | 30 | 30 | 30 | 30 | 30 | 30 | 30 |
| | Remarks | Preheating time 25 min. Cold chamber! | | | | | | | |

At the end, 161 l water in the apparatus. Interruption of run at 13.00 hrs.

TABLE 2

| | | Sterilization No. | | | | | | | | | |
|---|---|---|---|---|---|---|---|---|---|---|---|
| | | 1 | 2 | 3 | 4 | 5 | 6 | 7 | 8 | 9 | 10 |
| Steam Accumulator | Feed water quantity in column (1) | 192 | 182 | 178 | 173 | 164 | 169 | 158 | 151 | 147 | 143 |
| | Heating time (min) | Warm jacket | | | | | | | | | |
| | Pressure before sterilizing (bar) | 7.9 | 7.2 | 7.0 | 6.6 | 6.4 | 6.2 | 6.5 | 6.2 | 6.0 | 6.1 |
| | Pressure after sterilizing (bar) | 7.2 | 7.0 | 6.6 | 6.4 | 6.2 | 6.5 | 5.2 | 6.0 | 6.1 | 6.0 |
| | Condensate quantity (1) | 1 | 0.5 | 0.5 | 0.5 | 0.5 | | | | | |
| | Condensate temperature (°C.) | | | | | | | | | | |
| | Steam conductivity (μS/cm) | 0.8 | 0.5 | 0.45 | — | 0.6 | — | | 0.5 | | |
| | Remarks | | | | | | | | | | |
| | Sterilization starting time | 08.10 | 09.22 | 09.55 | 10.25 | 10.55 | 13.30 | 12.12 | 12.55 | 13.27 | |
| During Steril. Auto-Clave | Steam pressure (bar) | 2.4 | 2.1 | 2.1 | 2.1 | 2.2 | 2.2 | 2.2 | 2.2 | 2.2 | 2.2 |
| | Sterilizing time (min) | 12 | 12 | 12 | 12 | 12 | 12 | 12 | 12 | | |
| | Total time (min) | 70 | 30 | 30 | 30 | 30 | 30 | 30 | 30 | 30 | 30 |
| | Remarks | Autoclave temp. adjusted to correct value | | | | | | | | | |

In the evening at 16.00 hrs, 250 l water in the column. Autoclave jacket hot through the night. Power of heating resistances, 6 kW. During the night, about 13 l condensate came from the centrifugal separator.
Note:
In the evening, feed water cold; pressure 0.

What is claimed is:

1. Procedure for generating and accumulating steam for an autoclave or equivalent steam-operated device, comprising the steps of heating water in a closed tank which is only partially filled with the water until the unfilled portion of the tank contains steam under pressure, thus also causing the water in the tank to be under pressure, storing thermal energy in the the water that is under pressure, removing stored steam from the autoclave as required, thus generating steam from at least part of the water stored under pressure, maintaining heat on the water under pressure to replace thermal energy thereof which is lost upon conversion of water in the tank to steam, whereby steam is accumulated in the autoclave or equivalent device as steam is removed therefrom for use, and the load of the autoclave or equivalent device is equalized by the steam therein.

2. The procedure of claim 1, comprising the additional step of passing said accumulated steam through a purifier to purify the same prior to introduction into the autoclave or equivalent device.

3. The procedure of claim 1, wherein the water is stored under pressure greater than atmospheric pressure.

4. The procedure of claim 1, wherein said pressure under which the water is stored is considerably higher than sterilizing pressure in the autoclave or equivalent device.

5. The procedure of claim 1, wherein said pressure is about 8 bar.

6. The procedure of claim 1, wherein the water is turned into said steam by at least one of the steps of allowing pressure to fall within a tank or boiler in which the water is stored, and connecting an interior of the tank or boiler to a vacuum established in the autoclave or equivalent device.

7. The method of claim 1, comprising the additional step of equalizing only peak loads of the autoclave or equivalent steam-operated device.

8. The method of claim 1, comprising the additional step of equalizing the load of the autoclave or equivalent steam-operated device on a 24 hour basis.

9. Apparatus for generating and accumulating steam for equalizing load in an autoclave or equivalent steam-operated device comprising a boiler or tank for containing water under pressure in a predetermined volume which is less than the volume of the boiler or tank, means for heating the water in the boiler or tank to convert a portion of the water to steam, means for accumulating the steam thus converted under pressure in said boiler or tank, means for removing the steam from the water or tank as required, said means for heating the water in said boiler or tank being adapted to heat the water therein to generate additional steam upon the removal of steam from said boiler or tank, and means for feeding water into said boiler or tank to replace the water therein converted to steam.

10. The combination of claim 9, wherein said feeding means comprise a pump, said heating means comprise a heating element, and additionally comprising a steam withdrawal outlet from said boiler or tank, and a purifier for purifying the steam generated in said boiler or tank, and coupled to said steam withdrawal outlet.

11. The combination of claim 9, wherein said steam generating means comprise means for lowering the pressure within said boiler or tank.

12. The combination of claim 11, wherein said pressure lowering means comprise means for coupling an interior of said boiler or tank to a vacuum established in the autoclave or equivalent steam-operated device.

13. The combination of claim 10, wherein said heating element is situated inside said boiler or tank.

14. The combination of claim 10, wherein said heating element is situated outside of said boiler or tank.

15. The combination of claim 1, additionally comprising a purifier situated inside said boiler or tank or coupled to an interior of said boiler or tank from outside thereof.

16. The combination of claim 15, wherein said purifyer is a centrifugal purifier.

* * * * *